US009228576B2

(12) United States Patent
Yamamoto et al.

(10) Patent No.: US 9,228,576 B2
(45) Date of Patent: Jan. 5, 2016

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP); Masaki Ota, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 226 days.

(21) Appl. No.: 14/064,424

(22) Filed: Oct. 28, 2013

(65) Prior Publication Data

US 2014/0127041 A1 May 8, 2014

(30) Foreign Application Priority Data

Nov. 5, 2012 (JP) ..... 2012-243986

(51) Int. Cl.
*F04B 27/10* (2006.01)
*F04B 27/12* (2006.01)
*F04B 27/18* (2006.01)

(52) U.S. Cl.
CPC ..... *F04B 27/18* (2013.01); *F04B 27/12* (2013.01); *F04B 27/1072* (2013.01); *F04B 2027/1813* (2013.01)

(58) Field of Classification Search
CPC ..... F04B 27/10; F04B 27/12; F04B 27/14; F04B 27/16; F04B 27/18; F04B 27/1054; F04B 27/1072; F04B 27/1804; F04B 2720/1813
USPC ..... 417/222.1, 222.2, 269, 270
See application file for complete search history.

(56) References Cited

U.S. PATENT DOCUMENTS 4,037,993 A 7/1977 Roberts
4,061,443 A 12/1977 Black et al.
4,886,423 A * 12/1989 Iwanami et al. ..... 417/222.2
4,932,843 A * 6/1990 Itoigawa et al. ..... 417/222.1

(Continued)

FOREIGN PATENT DOCUMENTS

CN 1225422 8/1999
CN 2787875 6/2006

(Continued)

OTHER PUBLICATIONS

International Preliminary Report on Patentability for PCT/JP2013/079679, mailed May 5, 2015.

(Continued)

*Primary Examiner* — Peter J Bertheaud
(74) *Attorney, Agent, or Firm* — Greenblum & Bernstein, P.L.C.

(57) ABSTRACT

A compressor includes an actuator. The actuator is arranged in a swash plate chamber, while being rotational integrally with a drive shaft. With reference to the swash plate, the actuator is located in a region in which a first cylinder bore is located. The actuator includes a rotation body fixed to the drive shaft, a movable body, and a control pressure chamber. A link mechanism is located between the drive shaft and the swash plate. As the inclination angle of the swash plate is changed, the link mechanism moves the top dead center position of a first head by a greater amount than the top dead center position of a second head.

3 Claims, 4 Drawing Sheets

(56) References Cited

U.S. PATENT DOCUMENTS

| | | | | | |
|---|---|---|---|---|---|
| 4,963,074 | A | * | 10/1990 | Sanuki et al. | 417/222.1 |
| 5,002,466 | A | * | 3/1991 | Inagaki et al. | 417/222.1 |
| 5,022,826 | A | * | 6/1991 | Matsuda et al. | 417/63 |
| 5,032,060 | A | * | 7/1991 | Kobayashi et al. | 417/222.1 |
| 5,259,736 | A | * | 11/1993 | Terauchi | 417/222.1 |
| 5,370,503 | A | * | 12/1994 | Terauchi | 417/222.2 |
| 6,164,929 | A | | 12/2000 | Kazuya et al. | |
| 6,742,439 | B2 | | 6/2004 | Matsuda et al. | |
| 2012/0073430 | A1 | | 3/2012 | Uchikado | |

FOREIGN PATENT DOCUMENTS

| | | |
|---|---|---|
| JP | 52-131204 | 11/1977 |
| JP | 53-69911 | 6/1978 |
| JP | 58-162780 | 9/1983 |
| JP | 62-225782 | 10/1987 |
| JP | 64-41680 | 2/1989 |
| JP | 1-147171 | 6/1989 |
| JP | 2-16374 | 1/1990 |
| JP | 2-19665 | 1/1990 |
| JP | 2-132876 | 11/1990 |
| JP | 3-10082 | 1/1991 |
| JP | 3-134268 | 6/1991 |
| JP | 4-54287 | 2/1992 |
| JP | 5-18355 | 1/1993 |
| JP | 5-172052 | 7/1993 |
| JP | 5-312144 | 11/1993 |
| JP | 2002-21722 | 1/2002 |
| JP | 2002-349431 | 12/2002 |
| JP | 2004-60473 | 2/2004 |
| JP | 2007-239722 | 9/2007 |
| JP | 2010-281289 | 12/2010 |

OTHER PUBLICATIONS

Search report from P.C.T., mail date is Feb. 10, 2014.

U.S. Appl. No. 14/439,498, filed Apr. 29, 2015 to Hiroyuki Nakaima et al.

U.S. Appl. No. 14/064,864 to Shinya Yamamoto et al., filed Oct. 28, 2013.

U.S. Appl. No. 14/064,632 to Shinya Yamamoto et al., filed Oct. 28, 2013.

U.S. Appl. No. 14/064,733 to Shinya Yamamoto et al., filed Oct. 28, 2013.

U.S. Appl. No. 14/064,499 to Shinya Yamamoto et al., filed Oct. 28, 2013.

Office Action issued in China Counterpart Patent Appl. No. 201310524846.0, dated Aug. 5, 2015, along with an English translation thereof.

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Laid-Open Patent Publications No. 2-19665 and No. 5-172052 disclose conventional swash plate type variable displacement type compressors (hereinafter, referred to as compressors). The compressors include a suction chamber, a discharge chamber, a swash plate chamber, and a plurality of cylinder bores, which are formed in a housing. A drive shaft is rotationally supported in the housing. The swash plate chamber accommodates a swash plate, which is rotatable through rotation of the drive shaft. A link mechanism, which allows change of the inclination angle of the swash plate, is arranged between the drive shaft and the swash plate. The inclination angle is defined with respect to a line perpendicular to the rotation axis of the drive shaft.

Each of the cylinder bores accommodates a piston in a reciprocal manner and thus forms a compression chamber. Each cylinder bore is formed by a front cylinder bore arranged in front of the swash plate and a rear cylinder bore arranged behind the swash plate. Each piston includes front head, which reciprocates in the front cylinder bore, and a rear head, which is integral with the front head and reciprocates in the rear cylinder bore.

A conversion mechanism reciprocates each of the pistons in the associated one of the cylinder bores by the stroke corresponding to the inclination angle of the swash plate through rotation of the swash plate. An actuator is capable of changing the inclination angle of the swash plate and controlled by a control mechanism.

In the compressor described in Japanese Laid-Open Patent Publication No. 2-19665, a pressure regulation chamber is formed in a rear housing member of the housing. A control pressure chamber is formed in a cylinder block, which is also a component of the housing, and communicates with the pressure regulation chamber. The actuator is arranged in the control pressure chamber, while being prevented from rotating integrally with the drive shaft.

Specifically, the actuator has a non-rotational movable body that overlaps with a rear end portion of the drive shaft. The inner peripheral surface of the non-rotational movable body rotationally supports the rear end portion of the drive shaft. The non-rotational movable body is movable in the direction of the rotation axis of the drive shaft. The non-rotational movable body is slidable in the control pressure chamber through the outer peripheral surface of the non-rotational movable body and slides in the direction of the rotation axis of the drive shaft. The non-rotational movable body is restricted from sliding about the rotation axis of the drive shaft. A pressing spring, which urges the non-rotational movable body forward, is arranged in the control pressure chamber or the pressure regulation chamber. The actuator has a movable body, which is joined to the swash plate and movable in the direction of the rotation axis of the drive shaft. A thrust bearing is arranged between the non-rotational movable body and the movable body. A pressure control valve, which changes the pressure in the control pressure chamber, is provided between the pressure regulation chamber and the discharge chamber. Through such change of the pressure in the control pressure chamber, the non-rotational movable body and the movable body are moved along the rotation axis.

The link mechanism is arranged in the swash plate chamber. The link mechanism has a movable body and a lug arm fixed to the drive shaft. A rear end portion of the lug arm has an elongated hole. The elongated hole extends in a direction that is perpendicular to the rotation axis of the drive shaft and transverse to rotation axis of the drive shaft. A pin is received in the elongated hole and supports the swash plate at a position forward to the swash plate such that the swash plate is allowed to pivot about a first pivot axis.

In the compressor described in Japanese Laid-Open Patent Publication No. 5-172052, a front end portion of the movable body also has an elongated hole, which extends in the direction perpendicular to and transverse to the rotation axis of the drive shaft. A pin is passed through the elongated hole and supports the swash plate at the rear end of the swash plate such that the swash plate is allowed to pivot about a second pivot axis, which is parallel to the first pivot axis.

In these compressors, when a pressure regulation valve is controlled to open, communication between the discharge chamber and the pressure regulation chamber is allowed, which raises the pressure in the control pressure chamber compared to the pressure in the swash plate chamber. This causes the non-rotational movable body and the movable body to proceed. The inclination angle of the swash plate is thus increased and the stroke of each piston is increased correspondingly. This increases the displacement of the compressor per rotation cycle. In contrast, by controlling the pressure regulation valve to close, the communication between the discharge chamber and the pressure regulation chamber is blocked. This lowers the pressure in the control pressure chamber to a level equal to the pressure level in the swash plate chamber. This causes the non-rotational movable body and the movable body to retreat. The inclination angle of the swash plate is thus decreased and the piston stroke is decreased correspondingly in this compressor. This reduces the displacement of the compressor per rotation cycle.

In these compressors, the link mechanism is arranged such that, as the inclination angle of the swash plate is changed, the top dead center position of the piston front head is moved by a greater extent than the top dead center position of the piston rear head. Specifically, when the inclination angle of the swash plate is changed, the top dead center position of the piston rear head is scarcely moved, while the top dead center position of the piston front head is largely moved. As the inclination angle of the swash plate approaches zero degrees, the piston performs a little compression work only with the rear head, while performing no compression work with the front head.

In the above describe conventional compressors, however, the actuator is located behind the swash plate, or closer to the rear cylinder bores with respect to the swash plate. Therefore, in the housing of the compressor, it is difficult to create a space behind the swash plate for allowing the non-rotational movable body and the movable body to proceed and retreat. The size of the actuator in the radial direction thus needs to be reduced. However, it is difficult for a small actuator to perform the displacement control. If the radial size of the housing is increased to allow the inclination angle of the swash plate to be easily changed, the mountability of the compressor on a vehicle will be degraded.

SUMMARY OF THE INVENTION

Accordingly, it is an objective of the present invention to provide a compressor that is compact in size and ensures improved displacement control.

In accordance with one aspect of the present invention, a swash plate type variable displacement compressor includes a housing in which a suction chamber, a discharge chamber, a swash plate chamber, and a cylinder bore are formed, a drive shaft rotationally supported by the housing, a swash plate rotatable in the swash plate chamber by rotation of the drive shaft, a link mechanism, a piston, a conversion mechanism, an actuator, and a control mechanism. The link mechanism is arranged between the drive shaft and the swash plate and allows change of an inclination angle of the swash plate with respect to a line perpendicular to the rotation axis of the drive shaft. The piston is reciprocally received in the cylinder bore. The conversion mechanism causes the piston to reciprocate in the cylinder bore by a stroke corresponding to the inclination angle of the swash plate through rotation of the swash plate. The actuator is capable of changing the inclination angle of the swash plate. The control mechanism controls the actuator. The cylinder bore is formed by a first cylinder bore, which is located in a first region facing a first surface of the swash plate, and a second cylinder bore, which is located in a second region facing a second surface of the swash plate. The piston includes a first head, which reciprocates in the first cylinder bore, and a second head, which is integrated with the first head and reciprocates in the second cylinder bore. The link mechanism is configured such that, as the inclination angle is changed, a top dead center position of the first head is moved by a greater amount than a top dead center position of the second head. The actuator is arranged in the swash plate chamber and on a side of the swash plate where the first cylinder bore is located, and is integrally rotational with the drive shaft. The actuator includes a rotation body fixed to the drive shaft, a movable body, which is coupled to the swash plate and moves along the rotation axis of the drive shaft to be movable relative to the rotation body, and a control pressure chamber, which is defined by the rotation body and the movable body. An internal pressure of the control pressure chamber is changed such that the movable body is moved.

When the inclination angle of the swash plate of the compressor according to the present invention is changed, the top dead center position of the second head of the piston is scarcely moved, while the top dead center position of the first head of the piston is largely moved. This allows a relatively large space to be created in a region of the swash plate chamber where the first cylinder bore is located. With reference to the swash plate, the actuator is located in the region in which the first cylinder bore is located. Thus, in the compressor, the actuator can be easily increased in size in the radial direction without increasing the size of the housing in the radial direction.

Therefore, since the compressor according to the present invention is compact, it is possible to achieve an improved mountability and ensure improved displacement control.

DETAILED DESCRIPTION OF THE PREFERRED EMBODIMENTS

First and second embodiments of the present invention will now be described with reference to the attached drawings. A compressor of each of the first and second embodiments forms a part of a refrigeration circuit in a vehicle air conditioner and is mounted in a vehicle.

First Embodiment

Figure 1:
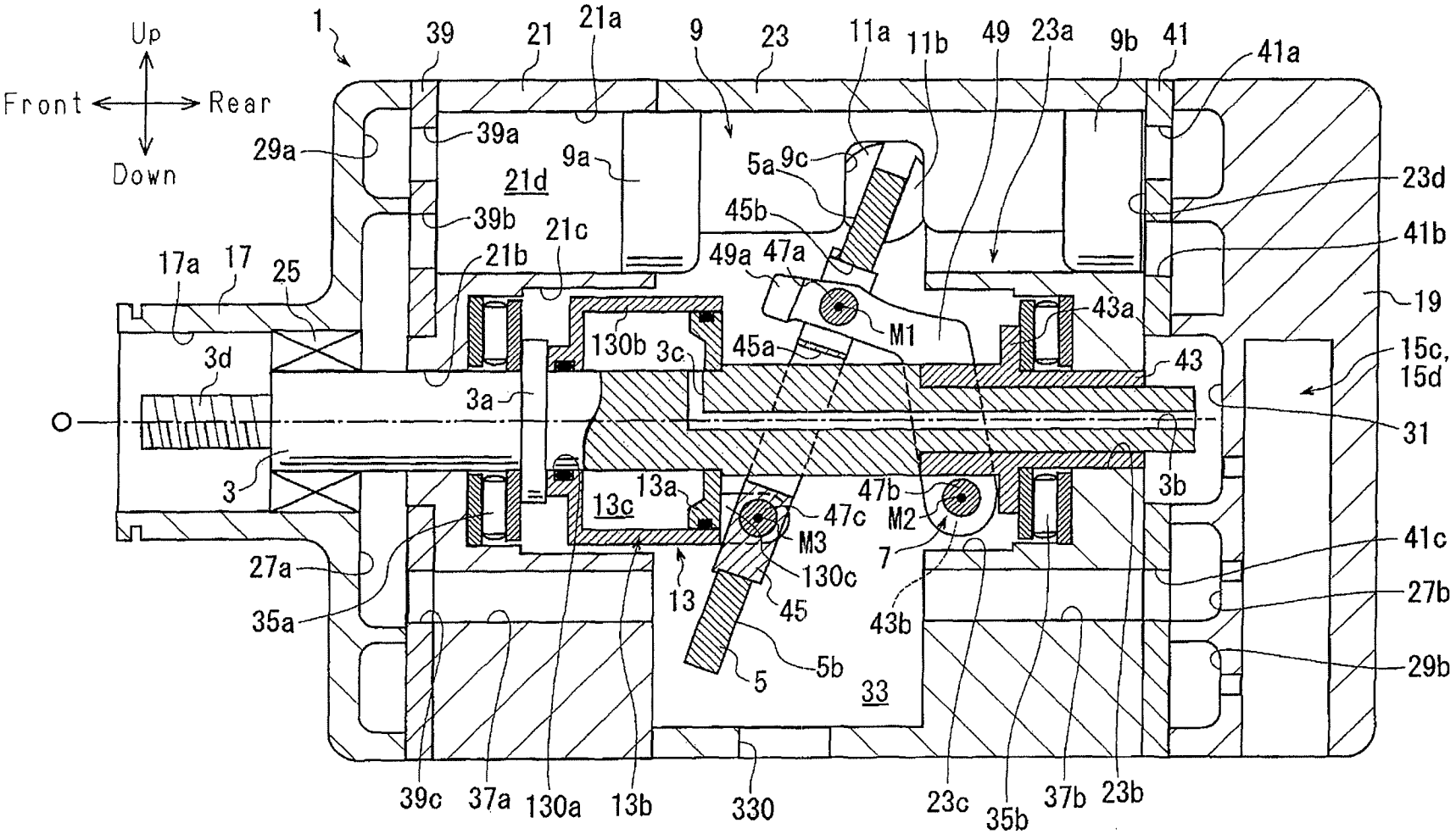
FIG. 1 is a cross-sectional view showing a compressor according to a first embodiment of the present invention in a state corresponding to the maximum displacement.
Figure 2:
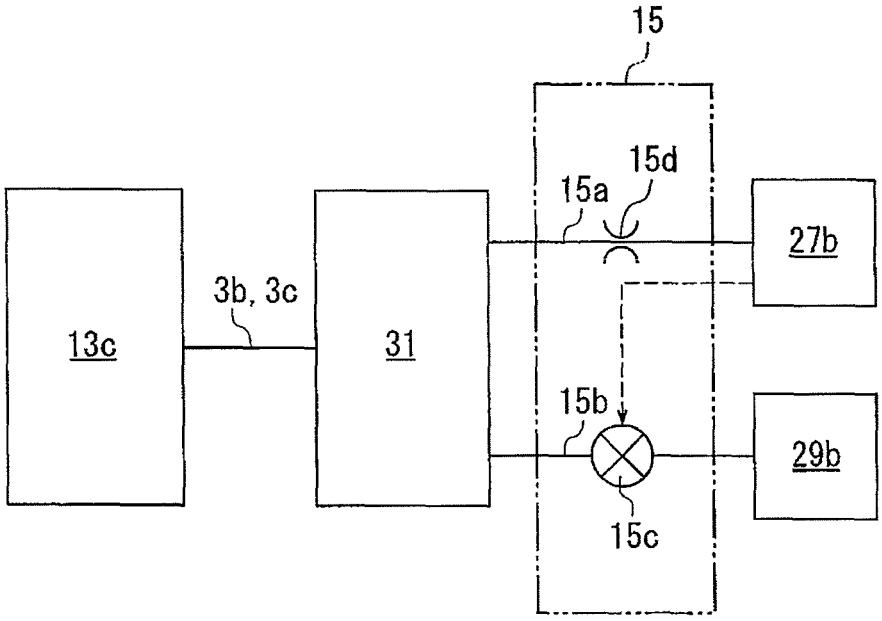
FIG. 2 is a schematic diagram showing a control mechanism of compressors according to the first embodiment.
Figure 3:
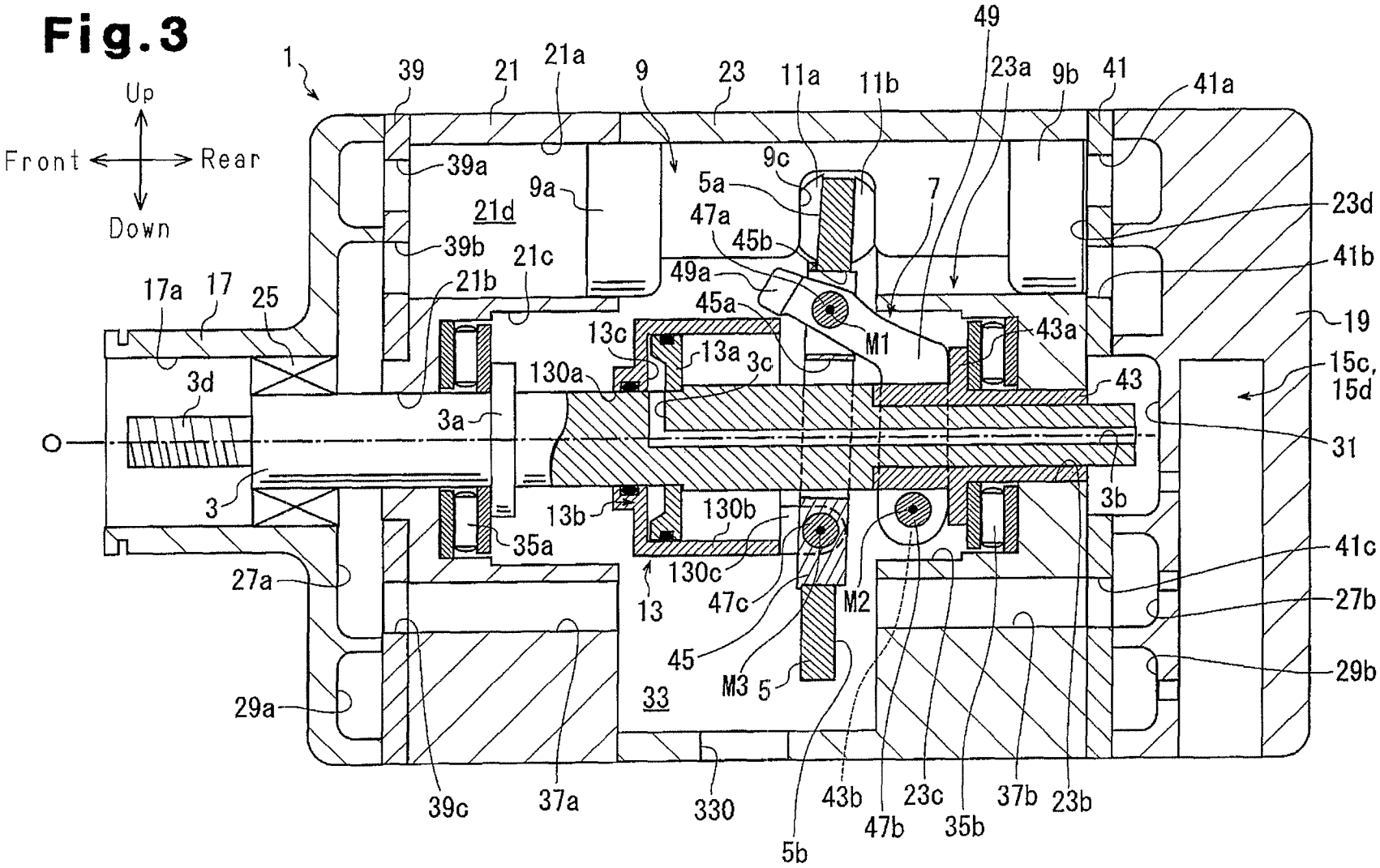
FIG. 3 is a cross-sectional view showing the compressor according to the first embodiment in a state corresponding to the minimum displacement.

As shown in FIGS. 1 and 3, a compressor according to a first embodiment of the invention includes a housing 1, a drive shaft 3, a swash plate 5, a link mechanism 7, a plurality of pistons 9, pairs of front and rear shoes 11*a*, 11*b*, an actuator 13, and a control mechanism 15, which is illustrated in FIG. 2.

With reference to FIG. 1, the housing 1 has a front housing member 17 at a front position in the compressor, a rear housing member 19 at a rear position in the compressor, and a first cylinder block 21 and a second cylinder block 23, which are arranged between the front housing member 17 and the rear housing member 19.

The front housing member 17 has a boss 17*a*, which projects forward. A shaft sealing device 25 is arranged in the boss 17*a* and arranged between the inner periphery of the boss 17*a* and the drive shaft 3. A suction chamber 27*a* and a first discharge chamber 29*a* are formed in the front housing member 17. The first suction chamber 27*a* is arranged at a radially inner position and the first discharge chamber 29*a* is located at a radially outer position in the front housing member 17.

A control mechanism 15 is received in the rear housing member 19. A second suction chamber 27*b*, a second discharge chamber 29*b*, and a pressure regulation chamber 31 are formed in the rear housing member 19. The second suction chamber 27*b* is arranged at a radially inner position and the second discharge chamber 29*b* is located at a radially outer position in the rear housing member 19. The pressure regulation chamber 31 is formed in the middle of the rear housing member 19. The first discharge chamber 29*a* and the second discharge chamber 29*b* are connected to each other through a non-illustrated discharge passage. The discharge passage has an outlet communicating with the exterior of the compressor.

A swash plate chamber 33 is formed by the first cylinder block 21 and the second cylinder block 23. The swash plate chamber 33 is arranged substantially in the middle of the housing 1.

A plurality of first cylinder bores 21*a* are formed in the first cylinder block 21 to be spaced apart concentrically at equal angular intervals, and extend parallel to one another.

The first cylinder block 21 has a first shaft hole 21*b*, through which the drive shaft 3 is passed. A first recess 21*c* is formed in the first cylinder block 21 at a position rearward to the first shaft hole 21*b*. The first recess 21*c* communicates with the first shaft hole 21*b* and is coaxial with the first shaft hole 21*b*. The first recess 21*c* communicates with the swash plate chamber 33. A step is formed in an inner peripheral surface of the first recess 21*c*. A first thrust bearing 35*a* is arranged at a front position in the first recess 21*c*. The first cylinder block 21 also includes a first suction passage 37*a*, through which the swash plate chamber 33 and the first suction chamber 27*a* communicate with each other.

As in the first cylinder block 21, a plurality of second cylinder bores 23*a* are formed in the second cylinder block 23.

A second shaft hole 23*b*, through which the drive shaft 3 is inserted, is formed in the second cylinder block 23. The second shaft hole 23*b* communicates with the pressure regulation chamber 31. The second cylinder block 23 has a second recess 23*c*, which is located forward to the second shaft hole 23*b* and communicates with the second shaft hole 23*b*. The second recess 23*c* and the second shaft hole 23*b* are coaxial with each other. The second recess 23*c* communicates with the swash plate chamber 33. A step is formed in an inner peripheral surface of the second recess 23*c*. A second thrust bearing 35*b* is arranged at a rear position in the second recess 23*c*. The second cylinder block 23 also has a second suction passage 37*b*, through which the swash plate chamber 33 communicates with the second suction chamber 27*b*.

The swash plate chamber 33 is connected to a non-illustrated evaporator through an inlet 330, which is formed in the second cylinder block 23.

A first valve plate 39 is arranged between the front housing member 17 and the first cylinder block 21. The first valve plate 39 has suction ports 39*b* and discharge ports 39*a*. The number of the suction ports 39*b* and the number of the discharge ports 39*a* are equal to the number of the first cylinder bores 21*a*. A non-illustrated suction valve mechanism is arranged in each of the suction ports 39*b*. Each one of the first cylinder bores 21*a* communicates with the first suction chamber 27*a* via the corresponding one of the suction ports 39*b*. A non-illustrated discharge valve mechanism is arranged in each of the discharge ports 39*a*. Each one of the first cylinder bores 21*a* communicates with the first discharge chamber 29*a* via the corresponding one of the discharge ports 39*a*. A communication hole 39*c* is formed in the first valve plate 39. The communication hole 39*c* allows communication between the first suction chamber 27*a* and the swash plate chamber 33 through the first suction passage 37*a*.

A second valve plate 41 is arranged between the rear housing member 19 and the second cylinder block 23. Like the first valve plate 39, the second valve plate 41 has suction ports 41*b* and discharge ports 41*a*. The number of the suction ports 41*b* and the number of the discharge ports 41*a* are equal to the number of the second cylinder bores 23*a*. A non-illustrated suction valve mechanism is arranged in each of the suction ports 41*b*. Each one of the second cylinder bores 23*a* communicates with the second suction chamber 27*b* via the corresponding one of the suction ports 41*b*. A non-illustrated discharge valve mechanism is arranged in each of the discharge ports 41*a*. Each one of the second cylinder bores 23*a* communicates with the second discharge chamber 29*b* via the corresponding one of the discharge ports 41*a*. A communication hole 41*c* is formed in the second valve plate 41. The communication hole 41*c* allows communication between the second suction chamber 27*b* and the swash plate chamber 33 through the second suction passage 37*b*.

The first suction chamber 27*a* and the second suction chamber 27*b* communicate with the swash plate chamber 33 via the first suction passage 37*a* and the second suction passage 37*b*, respectively. This substantially equalizes the pressure in the first and second suction chambers 27*a*, 27*b* and the pressure in the swash plate chamber 33. More specifically, the pressure in the swash plate chamber 33 is influenced by blow-by gas and thus slightly higher than the pressure in each of the first and second suction chambers 27*a*, 27*b*. The refrigerant gas sent from the evaporator flows into the swash plate chamber 33 via the inlet 330. As a result, the pressure in the swash plate chamber 33 and the pressure in the first and second suction chambers 27*a*, 27*b* are lower than the pressure in the first and second discharge chambers 29*a*, 29*b*. The swash plate chamber 33 is thus a low pressure chamber.

A swash plate 5, an actuator 13, and a flange 3*a* are attached to the drive shaft 3. The drive shaft 3 is passed rearward through the boss 17*a* and received in the first and second shaft holes 21*b*, 23*b* in the first and second cylinder blocks 21, 23. The front end of the drive shaft 3 is thus located inside the boss 17*a* and the rear end of the drive shaft 3 is arranged inside the pressure regulation chamber 31. The drive shaft 3 is supported by the walls of the first and second shaft holes 21*b*, 23*b* in the housing 1 in a manner rotatable about the rotation axis O. The swash plate 5, the actuator 13, and the flange 3*a* are accommodated in the swash plate chamber 33. A flange 3*a* is arranged between the first thrust bearing 35*a* and the actuator 13, or, more specifically, the first thrust bearing 35*a* and a movable body 13*b*, which will be described below. The flange 3*a* prevents contact between the first thrust bearing 35*a* and the movable body 13*b*. A radial bearing may be employed between the walls of the first and second shaft holes 21*b*, 23*b* and the drive shaft 3.

A support member 43 is mounted around a rear portion of the drive shaft 3 in a pressed manner. The support member 43 has a flange 43*a*, which contacts the second thrust bearing 35*b*, and an attachment portion 43*b*, through which a second pin 47*b* is passed as will be described below. An axial passage 3*b* is formed in the drive shaft 3 and extends from the rear end toward the front end of the drive shaft 3 in the direction of the rotation axis O. A radial passage 3*c* extends radially from the front end of the axial passage 3*b* and has an opening in the outer peripheral surface of the drive shaft 3. The axial passage 3*b* and the radial passage 3*c* are communication passages. The rear end of the axial passage 3*b* has an opening in the pressure regulation chamber 31, which is the low pressure chamber. The radial passage 3*c* has an opening in a control pressure chamber 13*c*, which will be described below.

The swash plate 5 is shaped as a flat annular plate and has a front surface 5*a* and a rear surface 5*b*. The front surface 5*a* of the swash plate 5 in the swash plate chamber 33 faces forward in the compressor. The rear surface 5*b* of the swash plate 5 in the swash plate chamber 33 faces rearward in the compressor. The front surface 5*a* and the rear surface 5*b* of the swash plate 5 correspond to a first surface and a second surface of the swash plate 5, respectively. In the compressor, the first cylinder bores 21*a* are located in a first region, which faces the front surface 5*a* of the swash plate 5, and the second cylinder bores 23*a* are located in a second region, which faces the rear surface 5*b* of the swash plate 5. The swash plate chamber 33 includes the first region and the second region, which are partitioned from each other by the swash plate 5, and the second region is smaller than the first region.

The swash plate 5 is fixed to a ring plate 45. The ring plate 45 is shaped as a flat annular plate and has a through hole 45*a* at the center. By passing the drive shaft 3 through the through hole 45*a*, the swash plate 5 is attached to the drive shaft 3 and thus arranged at a position in the vicinity of the second cylinder bores 23*a* in the swash plate chamber 33. In other words, the swash plate 5 is arranged at a position closer the rear end in the swash plate chamber 33.

The link mechanism 7 has a lug arm 49. The lug arm 49 is arranged rearward to the swash plate 5 in the swash plate chamber 33 and located between the swash plate 5 and the support member 43. The lug arm 49 substantially has an L shape. As illustrated in FIG. 3, the lug arm 49 comes into contact with the flange 43*a* of the support member 43 when the inclination angle of the swash plate 5 with respect to the rotation axis O is minimized. This allows the lug arm 49 to maintain the swash plate 5 at the minimum inclination angle in the compressor. A weight portion 49*a* is formed at the distal end of the lug arm 49. The weight portion 49*a* extends in the circumferential direction of the actuator 13 in correspondence with an approximately half the circumference. The weight portion 49*a* may be shaped in any suitable manner.

The distal end of the lug arm 49 is connected to the ring plate 45 through a first pin 47*a*. This configuration supports the distal end of the lug arm 49 to allow the distal end of the lug arm 49 to pivot about the axis of the first pin 47*a*, which is a first pivot axis M1, relative to the ring plate 45, or, in other words, relative to the swash plate 5. The first pivot axis M1 extends perpendicular to the rotation axis O of the drive shaft 3.

The basal end of the lug arm 49 is connected to the support member 43 through a second pin 47*b*. This configuration supports the basal end of the lug arm 49 to allow the basal end of the lug arm 49 to pivot about the axis of the second pin 47*b*, which is a second pivot axis M2, relative to the support member 43, or, in other words, relative to the drive shaft 3. The second pivot axis M2 extends parallel to the first pivot axis M1. The lug arm 49 and the first and second pins 47*a*, 47*b* correspond to the link mechanism 7 according to the present invention.

In the compressor, the swash plate 5 is allowed to rotate together with the drive shaft 3 by connection between the swash plate 5 and the drive shaft 3 through the link mechanism 7. Since the lug arm 49 is located between the swash plate 5 and the support member 43, the link mechanism 7 is located in the second region, which faces the rear surface 5*b* of the swash plate 5, in the swash plate chamber 33. In other words, the link mechanism 7 is located in the vicinity of the second cylinder bores 23*a*. That is, the link mechanism 7 is located behind the swash plate 5 in the swash plate chamber 33. The inclination angle of the swash plate 5 is changed through pivoting of the opposite ends of the lug arm 49 about the first pivot axis M1 and the second pivot axis M2 as illustrated in FIGS. 1 and 3.

The weight portion 49*a* is provided at the opposite side to the second pivot axis M2 with respect to the distal end of the lug arm 49, or, in other words, with respect to the first pivot axis M1. As a result, when the lug arm 49 is supported by the ring plate 45 through the first pin 47*a*, the weight portion 49*a* passes through a groove 45*b* in the ring plate 45 and reaches a position corresponding to the front surface of the ring plate 45, that is, the front surface 5*a* of the swash plate 5. As a result, the centrifugal force produced by rotation of the drive shaft 3 about the rotation axis O is applied to the weight portion 49*a* at the side corresponding to the front surface 5*a* of the swash plate 5.

Pistons 9 each include a first piston head 9*a* at the front end and a second piston head 9*b* at the rear end. The first piston head 9*a* and second piston head 9*b* correspond to a first head and a second head, respectively.

The first piston head 9*a* is reciprocally received in the corresponding first cylinder bore 21*a* and forms a first compression chamber 21*d*. The second piston head 9*b* is reciprocally accommodated in the corresponding second cylinder bore 23*a* and forms a second compression chamber 23*d*. Each of the pistons 9 has a recess 9*c*. Each of the recesses 9*c* accommodates semispherical shoes 11*a*, 11*b*. The shoes 11*a*, 11*b* convert rotation of the swash plate 5 into reciprocation of the pistons 9. The shoes 11*a*, 11*b* correspond to a conversion mechanism according to the present invention. The first and second piston heads 9*a*, 9*b* thus reciprocate in the corresponding first and second cylinder bores 21*a*, 23*a* by the stroke corresponding to the inclination angle of the swash plate 5.

The actuator 13 is accommodated in the swash plate chamber 33 at a position forward to the swash plate 5 and allowed to proceed into the first recess 21*c*. The actuator 13 has a rotation body 13*a* and a movable body 13*b*. The rotation body 13*a* has a disk-like shape and is fixed to the drive shaft 3. This allows the rotation body 13*a* only to rotate with the drive shaft 3. An O ring is attached to the outer periphery of the movable body 13*b*.

The movable body 13*b* is shaped as a cylinder and has a through hole 130*a*, a body portion 130*b*, and an attachment portion 130*c*. The drive shaft 3 is passed through the through hole 130*a*. The body portion 130*b* extends from the front side to the rear side of the movable body 13*b*. The attachment portion 130*c* is formed at the rear end of the body portion 130*b*. The drive shaft 3 extends into is the body portion 130*b* of the movable body 13*b* through the through hole 130*a*. The rotation body 13*a* is received in the body portion 130*b* in a manner that permits the body portion 130*b* to slide with respect to the rotation body 13*a*. This allows the movable body 13*b* to rotate together with the drive shaft 3 and move in the direction of the rotation axis O of the drive shaft 3 in the first region, which faces the front surface 5*a* of the swash plate 5, in the swash plate chamber 33. An O ring is mounted in the through hole 130*a*. The drive shaft 3 thus extends through the actuator 13 and allows the actuator 13 to rotate integrally with the drive shaft 3 about the rotation axis O.

By passing the drive shaft 3 through the actuator 13, the movable body 13*b* is arranged to face the link mechanism 7 with the swash plate 5 arranged in between in the swash plate chamber 33. More specifically, the actuator 13, which includes the movable body 13*b*, is located in the first region, which faces the front surface 5*a* of the swash plate 5, in the swash plate chamber 33, or in a region where the first cylinder bores 21*a* are located. That is, the actuator 13 is located in front of the swash plate 5 in the swash plate chamber 33. The actuator 13 is arranged in the first region, and the link mechanism 7 is arranged in the second region.

The ring plate 45 is connected to the attachment portion 130*c* of the movable body 13*b* through a third pin 47*c*. In this manner, the ring plate 45, or, in other words, the swash plate 5, is supported by the movable body 13*b* such that the ring plate 45, or the swash plate 5, is allowed to pivot about the third pin 47*c*, which is an operation axis M3. The operation axis M3 extend parallel to the first and second pivot axes M1, M2. The movable body 13*b* is thus held in a state connected to the swash plate 5. The movable body 13*b* comes into contact with the flange 3*a* when the inclination angle of the swash plate 5 is maximized. As a result, in the compressor, the movable body 13*b* is capable of maintaining the swash plate 5 at the maximum inclination angle.

The control pressure chamber 13*c* is defined between the rotation body 13*a* and the movable body 13*b*. The radial passage 3*c* has an opening in the control pressure chamber 13*c*. The control pressure chamber 13*c* communicates with the pressure regulation chamber 31 through the radial passage 3*c* and the axial passage 3*b*.

With reference to FIG. 2, the control mechanism 15 includes a bleed passage 15*a* and a supply passage 15*b* each serving as a control passage, a control valve 15*c*, and an orifice 15*d*.

The bleed passage 15*a* is connected to the pressure regulation chamber 31 and the second suction chamber 27*b*. The pressure regulation chamber 31 communicates with the control pressure chamber 13*c* through the axial passage 3*b* and the radial passage 3*c*. The bleed passage 15*a* thus allows communication between the control pressure chamber 13*c* and the second suction chamber 27*b*. The orifice 15*d* is formed in the bleed passage 15*a* to restrict the amount of the refrigerant gas flowing in the bleed passage 15*a*.

The supply passage 15*b* is connected to the pressure regulation chamber 31 and the second discharge chamber 29*b*. As a result, as in the case of the bleed passage 15*a*, the control pressure chamber 13*c* and the second discharge chamber 29*b* communicate with each other through the supply passage 15*b*, the axial passage 3*b*, and the radial passage 3*c*. In other words, the axial passage 3*b* and the radial passage 3*c* each configure a section in the bleed passage 15*a* and a section in the supply passage 15*b*, each of which serves as the control passage.

The control valve 15*c* is arranged in the supply passage 15*b*. The control valve 15*c* is capable of adjusting the opening degree of the supply passage 15*b* in correspondence with the pressure in the second suction chamber 27*b*. The control valve 15*c* thus adjusts the amount of the refrigerant gas flowing in the supply passage 15*b*. A publicly available valve may be employed as the control valve 15*c*.

A threaded portion 3*d* is formed at the distal end of the drive shaft 3. The drive shaft 3 is connected to a non-illustrated pulley or the pulley of a non-illustrated electromagnetic clutch through the threaded portion 3*d*.

A pipe (not shown) extending to the evaporator is connected to the inlet 330. A pipe extending to a condenser (neither is shown) is connected to the outlet. The compressor, the evaporator, an expansion valve, and the condenser configure the refrigeration circuit in the air conditioner for a vehicle.

In the compressor having the above-described configuration, the drive shaft 3 rotates to rotate the swash plate 5, thus reciprocating the pistons 9 in the corresponding first and second cylinder bores 21*a*, 23*a*. This varies the volume of each first compression chamber 21*d* and the volume of each second compression chamber 23*d* in correspondence with the piston stroke. The refrigerant gas is thus drawn from the evaporator into the swash plate chamber 33 via the inlet 330 and sent into the first and second suction chambers 27*a*, 27*b*. The refrigerant gas is then compressed in the first and second compression chambers 21*d*, 23*d* before being sent into the first and second discharge chambers 29*a*, 29*b*. The refrigerant gas is then sent from the first and second discharge chambers 29*a*, 29*b* into the condenser through the outlet.

In the meantime, rotation members including the swash plate 5, the ring plate 45, the lug arm 49, and the first pin 47*a* receive the centrifugal force acting in such a direction as to decrease the inclination angle of the swash plate 5. Through such change of the inclination angle of the swash plate 5, displacement control is carried out by selectively increasing and decreasing the stroke of each piston 9.

Specifically, in the control mechanism 15, when the control valve 15*c*, which is shown in FIG. 2, reduces the amount of the refrigerant gas flowing in the supply passage 15*b*, the amount of the refrigerant gas flowing from the pressure regulation chamber 31 into the second suction chamber 27*b* through the bleed passage 15*a* is increased. This substantially equalizes the pressure in the control pressure chamber 13*c* to the pressure in the second suction chamber 27*b*. As a result, as the centrifugal force acting on the rotation members moves the movable body 13*b* rearward, the control pressure chamber 13*c* is reduced in size and thus the inclination angle of the swash plate 5 is decreased.

In other words, as illustrated in FIG. 3, the swash plate 5 pivots about the operation axis M3. The opposite ends of the lug arm 49 pivot about the corresponding first and second pivot axes M1, M2, and the lug arm 49 approaches the flange 43*a* of the support member 43. This decreases the stroke of each piston 9, thus reducing the suction amount and displacement of the compressor per rotation cycle. The inclination angle of the swash plate 5 shown in FIG. 3 corresponds to the minimum inclination angle in the compressor.

The swash plate 5 of the compressor receives the centrifugal force acting on the weight portion 49*a*. Thus, the swash plate 5 of the compressor easily moves in such a direction as to decrease the inclination angle. The movable body 13*b* moves rearward in the axial direction of the drive shaft 3 and the rear end of the movable body 13*b* is arranged inward to the weight portion 49*a*. As a result, when the inclination angle of the swash plate 5 of the compressor is decreased, the weight portion 49*a* overlaps with approximately a half the rear end of the movable body 13*b*.

If the control valve 15*c* illustrated in FIG. 2 increases the amount of the refrigerant gas flowing in the supply passage 15*b*, the amount of the refrigerant gas flowing from the second discharge chamber 29*b* into the pressure regulation chamber 31 through the supply passage 15*b* is increased, in contrast to the case for decreasing the compressor displacement. The pressure in the control pressure chamber 13*c* is thus substantially equalized with the pressure in the second discharge chamber 29*b*. This moves the movable body 13*b* of the actuator 13 forward against the centrifugal force acting on the rotation members. This increases the volume of the control pressure chamber 13*c* and increases the inclination angle of the swash plate 5.

In other words, referring to FIG. 1, the swash plate 5 pivots about the operation axis M3 in the reverse direction. The opposite ends of the lug arm 49 pivot about the corresponding first and second pivot axes M1, M2 in the reverse directions, correspondingly. The lug arm 49 thus separates from the flange 43*a* of the support member 43. This increases the stroke of each piston 9, thus increasing the suction amount and displacement of the compressor per rotation cycle. The inclination angle of the swash plate 5 shown in FIG. 1 corresponds to the maximum inclination angle in the compressor.

In this compressor, the swash plate 5 and the drive shaft 3 are coupled to each other by the link mechanism 7, so that the swash plate 5 is located at a position in the swash plate chamber 33 that is closer to the second cylinder bores 23*a*. Accordingly, when the inclination angle of the swash plate 5 and the stroke of the pistons 9 are maximum in this compressor, the top dead center position of each first piston head 9*a* is closest to the first valve plate 39, and the top dead center position of the second piston head 9*b* is closest to the second valve plate 41. On the other hand, as the inclination angle of the swash plate 5 and the stroke of the pistons 9 decrease, the top dead center position of each first piston head 9*a* is gradually separated from the first valve plate 39. However, the top dead center position of each piston head 9*b* remains substantially unchanged from the state in which the stroke of each piston 9 is maximum and at the position close to the second valve plate 41.

As described above, when the inclination angle of the swash plate 5 of the compressor is changed, the top dead center position of the second piston head 9*b* of each piston 9 is scarcely moved, while the top dead center position of the first piston head 9*a* of the piston 9 is largely moved. Thus, with reference to the swash plate 5, a relatively large space is created in a region in the swash plate chamber 33 where the first cylinder bores 21*a* are located. Also, with reference to the swash plate 5, the actuator 13 is located in the region in the swash plate chamber 33 where the first cylinder bores 21*a* are located. Thus, in the compressor, the radial size of the actuator 13 can be increased without increasing the radial size of the housing 1, so that the size of the control pressure chamber 13*c* is ensured to be large. Accordingly, the movable body 13*b* is moved in a desirable manner based on fluctuation in the pressure of the refrigerant gas in the swash plate chamber 33 of the compressor.

Also, the link mechanism 7 of the compressor is located on the opposite side of the swash plate 5 from the movable body 13*b* and in a region where the second cylinder bores 23*a* are located. When the inclination angle of the swash plate 5 of the compressor is changed, the top dead center position of the second piston head 9*b* of each piston 9 is scarcely changed. Thus, only a relatively small space can be created in the region where the second cylinder bores 23*a* are located with reference to the swash plate 5 in the swash plate chamber 33. However, the link mechanism 7 of the compressor only functions to allow the inclination angle of the swash plate 5 to be changed. Also, since the lug arm 49 substantially has an L-shape, the lug arm 49 can be made compact and is ensured to have a sufficient range of pivoting. Accordingly, even though the link mechanism 7 is located in a narrow region in the swash plate chamber 33 where the second cylinder bores 23*a* are arranged, the link mechanism 7 is allowed to function sufficiently.

Further, since the link mechanism 7 of the compressor is located on the opposite side of the swash plate 5 from the movable body 13*b* and in a region where the second cylinder bores 23*a* are located, a large space can be created in the region in the swash plate chamber 33 where the first cylinder bores 21*a* are located.

Therefore, since the compressor according to the first embodiment is compact, it is possible to achieve an improved mountability to a vehicle and ensure improved displacement control.

Also, in the control mechanism 15 of the compressor, the bleed passage 15*a* allows communication between the control pressure chamber 13*c* and the second suction chamber 27*b*. The supply passage 15*b* allows communication between the control pressure chamber 13*c* and the second discharge chamber 29*b*. The control valve 15*c* adjusts the opening degree of the supply passage 15*b*. As a result, the compressor quickly raises the pressure in the control pressure chamber 13*c* using the high pressure in the second discharge chamber 29*b*, thus increasing the compressor displacement rapidly.

Further, the swash plate chamber 33 of the compressor is used as a path of the refrigerant gas to the first and second suction chambers 27*a*, 27*b*. This brings about a muffler effect. As a result, suction pulsation of the refrigerant gas is reduced to decrease the noise produced by the compressor.

Second Embodiment

Figure 4:
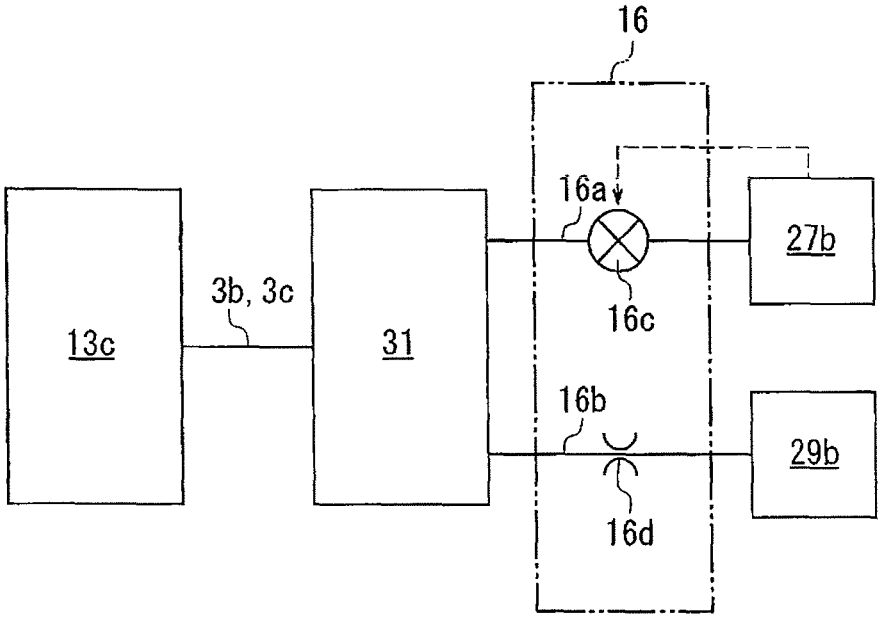
FIG. 4 is a schematic diagram showing a control mechanism of compressors according to a second embodiment.

A compressor according to a second embodiment of the invention includes a control mechanism 16 illustrated in FIG. 4, instead of the control mechanism 15 of the compressor of the first embodiment. The control mechanism 16 includes a bleed passage 16*a* and a supply passage 16*b* each serving as a control passage, a control valve 16*c*, and an orifice 16*d*.

The bleed passage 16*a* is connected to the pressure regulation chamber 31 and the second suction chamber 27*b*. This configuration allows the bleed passage 16*a* to ensure communication between the control pressure chamber 13*c* and the second suction chamber 27*b*. The supply passage 16*b* is connected to the pressure regulation chamber 31 and the second discharge chamber 29*b*. The control pressure chamber 13*c* and the pressure regulation chamber 31 thus communicate with the second discharge chamber 29*b* through the supply passage 16*b*. The orifice 16*d* is formed in the supply passage 16*b* to restrict the amount of the refrigerant gas flowing in the supply passage 16*b*.

The control valve 16*c* is arranged in the bleed passage 16*a*. The control valve 16*c* is capable of adjusting the opening degree of the bleed passage 16*a* in correspondence with the pressure in the second suction chamber 27*b*. The control valve 16*c* thus adjusts the amount of the refrigerant flowing in the bleed passage 16*a*. As in the case of the aforementioned control valve 15*c*, a publicly available product may be employed as the control valve 16*c*. The axial passage 3*b* and the radial passage 3*c* each configure a section of the bleed passage 16*a* and a section of the supply passage 16*b*. The other components of the compressor of the second embodiment are configured identically with the corresponding components of the compressor of the first embodiment. Accordingly, these components are referred to using common reference numerals and detailed description thereof is omitted herein.

In the control mechanism 16 of the compressor, if the control valve 16*c* decreases the amount of the refrigerant gas flowing in the bleed passage 16*a*, the flow of refrigerant gas from the second discharge chamber 29*b* into the pressure regulation chamber 31 via the supply passage 16*b* and the orifice 16*d* is promoted. This substantially equalizes the pressure in the control pressure chamber 13*c* to the pressure in the second discharge chamber 29*b*. This moves the movable body 13*b* of the actuator 13 forward against the centrifugal force acting on the rotation members. This increases the volume of the control pressure chamber 13*c* and increases the inclination angle of the swash plate 5.

In the compressor of the second embodiment, the inclination angle of the swash plate 5 is increased to increase the stroke of each piston 9, thus raising the suction amount and displacement of the compressor per rotation cycle, as in the case of the compressor according to the first embodiment (see FIG. 1).

In contrast, if the control valve 16*c* illustrated in FIG. 4 increases the amount of the refrigerant gas flowing in the bleed passage 16*a*, refrigerant gas from the second discharge chamber 29*b* is less likely to flow into and be stored in the pressure regulation chamber 31 through the supply passage 16*b* and the orifice 16*d*. This substantially equalizes the pressure in the control pressure chamber 13*c* to the pressure in the second suction chamber 27*b*. The movable body 13*b* is thus moved rearward by the centrifugal force acting on the rotation body. This reduces the volume of the control pressure chamber 13*c*, thus decreasing the inclination angle of the swash plate 5.

As a result, by decreasing the inclination angle of the swash plate 5 and thus the stroke of each piston 9, the suction amount and displacement of the compressor per rotation cycle are lowered (see FIG. 3).

As has been described, the control mechanism 16 of the compressor of the second embodiment adjusts the opening degree of the bleed passage 16*a* by means of the control valve 16*c*. The compressor thus slowly lowers the pressure in the control pressure chamber 13*c* using the low pressure in the second suction chamber 27*a* to maintain desirable driving comfort of the vehicle. The other operations of the compressor of the second embodiment are the same as the corresponding operations of the compressor of the first embodiment.

Although the present invention has been described referring to the first and second embodiments, the invention is not limited to the illustrated embodiments, but may be modified as necessary without departing from the scope of the invention.

For example, in the compressors of the first and second embodiments, refrigerant gas is sent into the first and second suction chambers 27*a*, 27*b* via the swash plate chamber 33. However, the refrigerant gas may be drawn into the first and second suction chambers 27*a*, 27*b* directly from the corresponding pipe through the inlet. In this case, the compressor should be configured to allow communication between the first and second suction chambers 27*a*, 27*b* and the swash plate chamber 33 so that the swash plate chamber 33 corresponds to a low pressure chamber.

The compressors of the first and second embodiments may be configured without the pressure regulation chamber 31.

The invention claimed is:

1. A swash plate type variable displacement compressor comprising:

a housing in which a suction chamber, a discharge chamber, a swash plate chamber, and a cylinder bore are formed;

a drive shaft rotationally supported by the housing;

a swash plate rotatable in the swash plate chamber by rotation of the drive shaft;

a link mechanism arranged between the drive shaft and the swash plate, the link mechanism allowing change of an inclination angle of the swash plate with respect to a line perpendicular to the rotation axis of the drive shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator capable of changing the inclination angle of the swash plate; and a control mechanism that controls the actuator, wherein the cylinder bore is formed by a first cylinder bore, which is located in a first region facing a first surface of the swash plate, and a second cylinder bore, which is located in a second region facing a second surface of the swash plate, the piston includes a first head, which reciprocates in the first cylinder bore, and a second head, which is integrated with the first head and reciprocates in the second cylinder bore, the link mechanism is configured such that, as the inclination angle is changed, a top dead center position of the first head is moved by a greater amount than a top dead center position of the second head, the actuator is arranged in the swash plate chamber and on a side of the swash plate where the first cylinder bore is located, and is integrally rotational with the drive shaft, and the actuator includes a rotation body fixed to the drive shaft, a movable body, which is coupled to the swash plate and moves along the rotation axis of the drive shaft to be movable relative to the rotation body, and a control pressure chamber, which is defined by the rotation body and the movable body, wherein an internal pressure of the control pressure chamber is changed such that the movable body is moved.

2. The swash plate type variable displacement compressor according to claim 1, wherein the link mechanism is located in a region on the opposite side of the swash plate from the movable body and where the second cylinder bore is located.

3. The swash plate type variable displacement compressor according to claim 1, wherein the swash plate chamber includes the first region and the second region, which are partitioned from each other by the swash plate, and the second region is smaller than the first region, the actuator is arranged in the first region, and the link mechanism is arranged in the second region.

* * * * *